US007665487B2

(12) United States Patent
Debaes et al.

(10) Patent No.: US 7,665,487 B2
(45) Date of Patent: Feb. 23, 2010

(54) DEVICE FOR DRIVING A RAPIER MOTION IN A WEAVING MACHINE

(75) Inventors: Johny Debaes, Moorslede (BE); Dominique Maes, Wakken (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 124 days.

(21) Appl. No.: 11/410,990

(22) Filed: Apr. 25, 2006

(65) Prior Publication Data

US 2006/0249222 A1 Nov. 9, 2006

(30) Foreign Application Priority Data

Apr. 25, 2005 (BE) ..... 2005/0214

(51) Int. Cl.
*D03D 47/00* (2006.01)

(52) U.S. Cl. ..... 139/449; 139/441

(58) Field of Classification Search ..... 139/449, 139/450, 441–445
See application file for complete search history.

(56) References Cited

U.S. PATENT DOCUMENTS 4,102,363 A * 7/1978 Deborde ..... 139/449
5,035,268 A * 7/1991 Bucher ..... 139/449
5,114,775 A * 5/1992 Gsell et al. ..... 428/107
5,150,631 A * 9/1992 Faerber et al. ..... 74/422
5,785,095 A * 7/1998 Kinbara ..... 139/449
6,672,790 B2 * 1/2004 Davis ..... 403/267
2003/0164055 A1 * 9/2003 Davis ..... 74/422

FOREIGN PATENT DOCUMENTS

DE 10120954 10/2002
EP 0394639 10/1990

* cited by examiner

*Primary Examiner*—Shaun R Hurley
*Assistant Examiner*—Andrew W Sutton
(74) *Attorney, Agent, or Firm*—James Creighton Wray; Meera P. Narasimhan

(57) ABSTRACT

On the one hand, this invention relates to a method for manufacturing a toothed rack from an elastic material, the toothed rack being provided with teeth, the said toothed rack, in pre-stressed condition, being wrapped up in one or several layers of fiber reinforced synthetic cloth around at least part of the height of its lateral faces which are almost at right angles to the surface in which the teeth are situated and, on the other hand, a toothed rack manufactured according to this method. Furthermore, this invention relates to a rapier rod profile for a rapier weaving machine provided with a toothed rack according to the invention.

19 Claims, 3 Drawing Sheets

DEVICE FOR DRIVING A RAPIER MOTION IN A WEAVING MACHINE

This application claims the benefit of Belgian Application No. 2005/0214 filed Apr. 25, 2005, which is hereby incorporated by reference in its entirety.

BACKGROUND OF THE INVENTION

On the one hand, this invention relates to a method for manufacturing a toothed rack from an elastic material, the toothed rack being provided with teeth, and a toothed rack manufactured in accordance with this method on the other hand. Furthermore, this invention relates to a rapier rod profile for a rapier weaving machine provided with a toothed rack according to the invention.

In a rapier weaving machine, the rapiers are used to conduct weft yarns through the shed. Usually, two rapiers are operating, each coming from a different side of the weaving machine, in order to conduct the weft together through the shed. There are embodiments in existence where, from one side of the weaving machine, one rapier is conducting the weft yarn across the full width of the weaving machine. Each rapier here, is linked to the extremity of a rapier rod. In order to perform a reciprocating motion, the rapier rod is guided in a rapier guiding device and in order to drive the motion, it is comprising a toothed rack provided with teeth in mesh with a gear wheel, attached to a shaft installed in a horizontal or possibly a vertical position.

Since there is a tendency towards weaving machines operating at increasingly high speeds, also the speed at which the rapier rod is moving through the shed is increasing. Moreover, the rapier has to pick up or to drop the weft yarn at one end of the motion, and to transmit or to take over the weft yarn at the other end of its motion. During this take over the rapier will come to a halt each time to resume its full speed in the other direction.

The shock loads occurring during this reversal of the motion are considerable and are strongly increasing at increasing operational speeds or at increasing width of the weaving machine and also at increasing weight of the moving portion, more particularly the weight of the rapier and the rapier rod. These shock loads are transmitted by the driving gearwheel to the teeth of the rapier rod, because of which the toothed rack part of the rapier rod is subjected to a heavy strain.

The toothed rack should have both elastic properties to absorb the shock load and at the same time, the whole, including the rapier rod profile, should be sufficiently strong and stiff to resist the effect of the forces occurring.

For the absorbing effect, the toothed rack is therefore made of an elastic material. In order to be able to resist the effect of the forces occurring, the toothed rack is fixed in a strong and stiff rapier rod. Since the effect of the forces occurring is essentially of a dynamic nature, this means that when mass of the whole moving along (rapier rod with toothed rack in combination with the rapier) may be removed while the remaining stiffness will be sufficient, this will offer the essential advantage of being able to weave at a higher speed.

According to the state-of-the-art, many attempts have been made to reduce the weight of the moving portion, more particularly by making use of other materials: therefore, in the publication of the German patent DE-PS 3527202, the rapier rod is made with an integrated toothed rack profile of a synthetic material, reinforced with carbon fibres in order to reduce the effect of the dynamic forces occurring without using great masses.

The reinforced synthetic material is machined layer after layer, the layers being stacked one on top of the other, pressed together and cured to become a whole. This method is an expensive and labour-intensive operation, the accuracy of form of the teeth being difficult to realize by this stacking method. Moreover, in each layer, fibres are cut through near the tooth profile. This will give cause to premature wear, the more as these fibres cut through are situated in the area where the load is most heavy.

The publication of the German patent DE 3638673 shows an embodiment of the rapier rod, where the toothed rack is made of elastic synthetic material, which, in the most heavy loaded area right below the surface of the tooth from top to root, is reinforced by means of carbon fibres, following the profile of the tooth. The cost here, will be reduced by using the expensive carbon fibres only locally, but the production method remains difficult, time-consuming and delicate.

The publication of the European patent EP 394639 a separate toothed rack being glued to a rapier rod profile is again aimed at. The toothed part is made of carbon fibre reinforced synthetic material, the fibres following the teeth and not being cut through. The teeth being hollow here, which means that when gluing the toothed rack to the rapier rod profile only the root of the tooth will become attached. This embodiment is still expensive to produce, and gluing the toothed rack onto the rapier rod profile remains a delicate operation, as the glued joint has to be capable of absorbing considerable forces. Moreover, with such an embodiment, gluing remains limited to relatively small surfaces at the root of the tooth.

In the publication of the German patent DE 19608254, a tooth profile, as described in EP 394639 is integrated into a rapier rod to form a whole. This will be a favourable, as the weight of the rapier rod is concerned, however, it still remains a delicate en complicated operation in order to obtain the final result desired.

Because of what has been said above, for practical uses, toothed racks made of an elastic synthetic material attached to carbon fibre reinforced rapier rod profiles are still used today.

SUMMARY OF THE INVENTION

The purpose of the invention is to provide a method enabling the rapier rod to be made lighter, without loosing its stiffness and accuracy in a production-friendly method, enabling the operational speed to be increased and/or wear to be reduced.

The purpose of the invention is attained by providing a method to manufacture a toothed rack from an elastic material, the toothed rack being provided with teeth, the said toothed rack, in a pre-stressed condition, being wrapped up in one or several layers of fibre reinforced synthetic cloth around at least part of the height of the lateral faces which are almost at right angles to the surface in which the teeth are situated. Preferably, the fibre reinforced synthetic cloth is a flat fabric, no fibres being cut through in the critically loaded zones. In a preferred embodiment the toothed rack is wrapped up in one or several layers of fibre reinforced synthetic cloth impregnated with resin, after which the toothed rack being wrapped up is then cured.

Preferably, the toothed rack, wrapped up in fibre reinforced synthetic cloth is attached in a rapier rod profile, preferably made of fibre reinforced synthetic material. The toothed rack may be attached to the rapier rod profile by any kind of joint, preferably by gluing, fixing under stress or by means of some mechanical attachment.

The advantage of the method according to the invention is, that the toothed rack may be made lighter constructively as a result of the increased stiffness on the one hand. On the other hand, the fibre reinforced synthetic cloth is absorbing the forces caused by pre-stressing, because of which these forces are no longer transmitted to a rapier rod profile and consequently this part may also be made lighter.

In order not to have the rapier rod profile ending at one of the teeth of the toothed rack, which may lead to a deformation of that tooth because of the stress exerted on the fibre reinforced synthetic cloth or, on the other hand, to be able to attach the rapier, in a particular method according to the invention, the said toothed rack is provided, at at least one of its extremities, with a terminal piece made of an essentially solid material. Preferably, the terminal piece is made of the same material as the toothed rack.

In a more preferred method according to the invention, the said terminal piece is made to be an integral part of the toothed rack, such that the terminal piece is integrated into the toothed rack.

In another preferred method according to the invention, the said terminal piece is attached to the toothed rack, preferably by injection moulding.

In a most preferred method according to the invention, the said terminal piece, is wrapped up in the fibre reinforced synthetic cloth, together with the toothed rack.

When the terminal pieces are an integral part of the toothed rack, because of the pre-stress caused by the fibre reinforced synthetic cloth in which they are wrapped up, they will constitute a whole which is significantly stiffer, than in a not pre-stressed condition. This reinforced material is more suitable to be attached to the rapier. Since the terminal piece is part of the toothed rack, also the necessity to provide the toothed rack with accessories, in order to be in mesh with the teeth of the toothed rack and to be attached to the toothed rack, has disappeared which will reduce the total weight of the rapier rod. In a preferred embodiment, the toothed rack is made of synthetic material.

Another object of this patent application, relates to a toothed rack made of an elastic material comprising a toothed part, the said toothed rack being wrapped up in a pre-stressed condition in one or several layers of fibre reinforced synthetic cloth around at least part of the height of the lateral faces being almost at right angles to the surface in which the teeth are situated. Preferably, the said synthetic cloth is comprising fibres chosen from carbon fibres, glass fibres and/or aramide fibres.

In a preferred embodiment of the toothed rack, the said synthetic cloth is impregnated with a resin, because of which the fibre reinforced synthetic cloth may be cured after having been wrapped around the toothed rack.

Wrapping up the toothed rack may be done all along the height of the toothed rack, but in a more preferred embodiment of the toothed rack, the toothed rack is made stepped, because of which the toothed rack is provided with an edge on the side of the teeth and the synthetic cloth being situated against the said edge. This embodiment has the advantage that the stress caused by the fibre reinforced synthetic cloth (which has been installed under stress) is not exerting a pressure on the top of the teeth of the toothed rack. Consequently, this top of the teeth, having a more limited resistance as deformation is concerned, will be less deformed.

In a most preferred embodiment of the toothed rack according to the invention, the toothed rack is made by means of a method according to any one of the claims 1 up to and including 8.

This patent application further comprises a rapier rod profile for a rapier weaving machine, where the rapier rod profile is provided with a toothed rack according to any one of the claims 9 up to and including 13 and a rapier weaving machine, the said weaving machine being provided with a rapier rod profile according to claim 14. The reduction in weight thus obtained enables the rapier weaving machine to operate at higher speeds and to have less wear.

In order to further clarify the properties of the present invention and to point out the special advantages and its particulars, a more detailed description of the method applied and of the toothed rack manufactured in accordance with this method will now follow. It may be obvious that nothing of the following description may be interpreted as being a restriction of the protection of this invention demanded for in the claims.

In this description, by means of reference numbers, reference is made to the drawings attached in which:

DETAILED DESCRIPTION OF THE PREFERRED EMBODIMENTS

Figure 1:
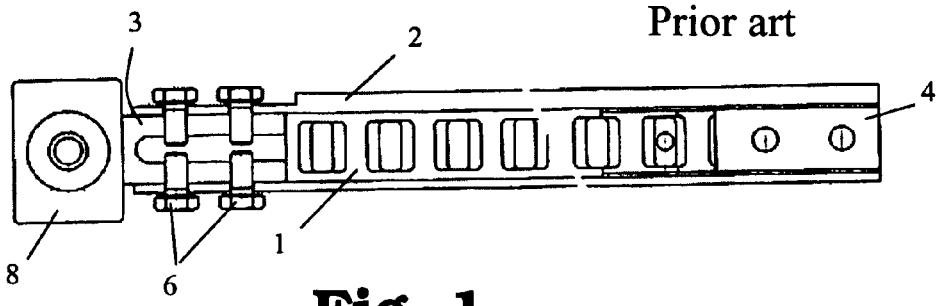
FIG. 1 is representing a rapier rod in accordance with the state-of-the-art, seen from the side of the driving gearwheel.
Figure 2:
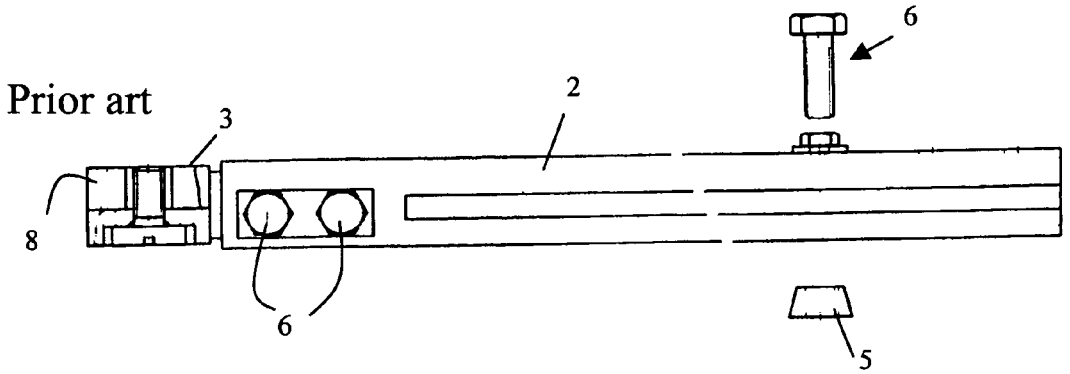
FIG. 2 is representing a bottom view of a rapier rod in accordance with the state-of-the-art.
Figure 3:
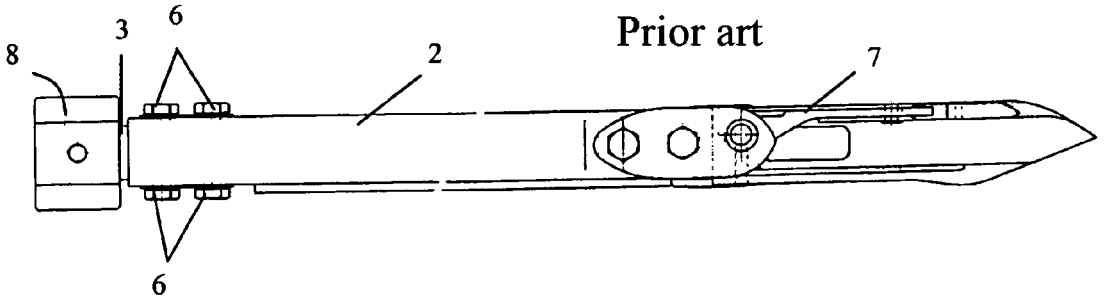
FIG. 3 is representing a side view of a rapier rod in accordance with the state-of-the-art, seen from the side, away from the driving gearwheel and with a rapier attached to it.

A toothed rack (1), accurately shaped during production from an elastic material (such as, for instance, a synthetic material) according to the state-of-the-art (see FIGS. 1 up to and including 3), is deformed as a consequence of the environmental conditions into inaccurate teeth, and consequently, the gearwheel will be inaccurately in mesh. In order to prevent this, the toothed rack is glued under a pre-stress and in a straightening gauge onto the rapier rod profile (2). In this manner, the combination of toothed rack (1) and rapier rod profile (2) will maintain its tooth accuracy. This pre-stressing force, added to the high dynamic effect of the forces acting on the toothed rack (1), in many cases, will be too high a strain for the glued joint and consequently will cause damage to the toothed rack (1) and consequently will break it.

In order to avoid the full load of the force for pre-stressing to be applied to this combination of toothed rack (1) and rapier rod profile (2) glued together, terminal elements (3, 4) will be mechanically attached to the rapier rod profile (2), at both extremities of the toothed rack. This means that additional elements (3, 4, 5) have to be used (terminal elements (3, 4) and accessory (5)), which most of the time are attached to the rapier rod profile (2) by means of bolts (6), for pre-stressing the toothed rack (1) in its right position and gluing it. On one side, this terminal element (4) is also used to attach the rapier (7). At the same time, it is still possible to attach a guiding part (8) to the terminal element (3) concerned at the other extremity away from the rapier (7). The guiding part (8) will guide the rapier rod in the rapier guiding device.

On the one hand, the terminal elements (3, 4), together with their mechanical connecting elements (5, 6) (mostly made of metal) will cause a considerable increase in weight of the rapier rod and, on the other hand, will cause the whole constituted by the toothed rack (1) and the rapier rod profile (2) to be weakened by holes to be made.

Figure 4:
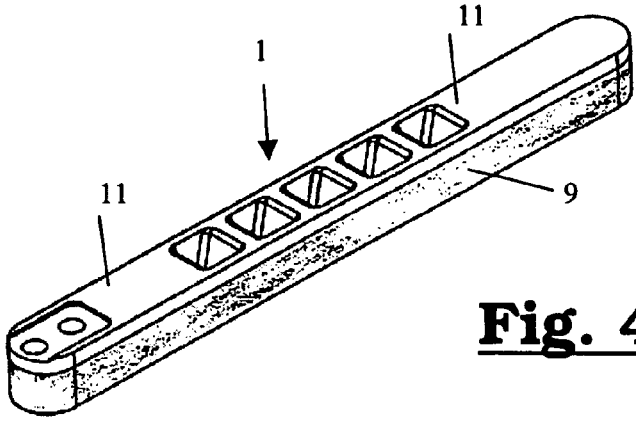
FIG. 4 is a representation of the toothed rack with the wrapped up fibre reinforced synthetic cloth according to the invention.
Figure 5:
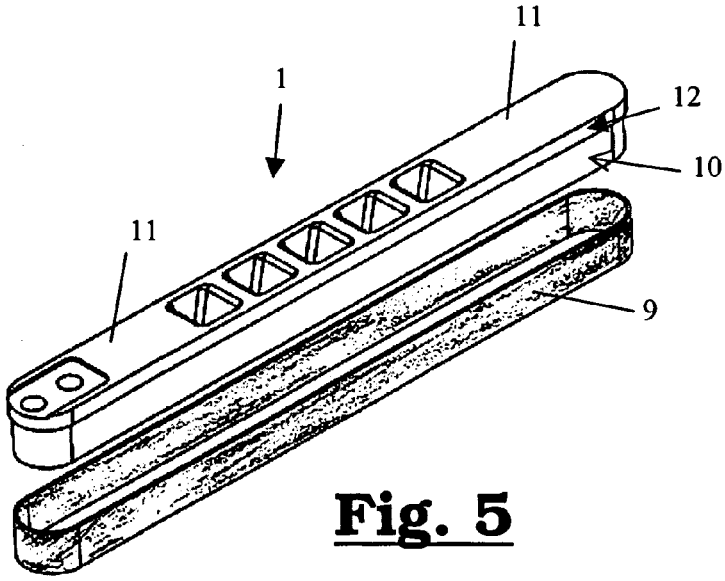
FIG. 5 is an exploded view of the toothed rack with the wrapped up fibre reinforced synthetic cloth.
Figure 6:
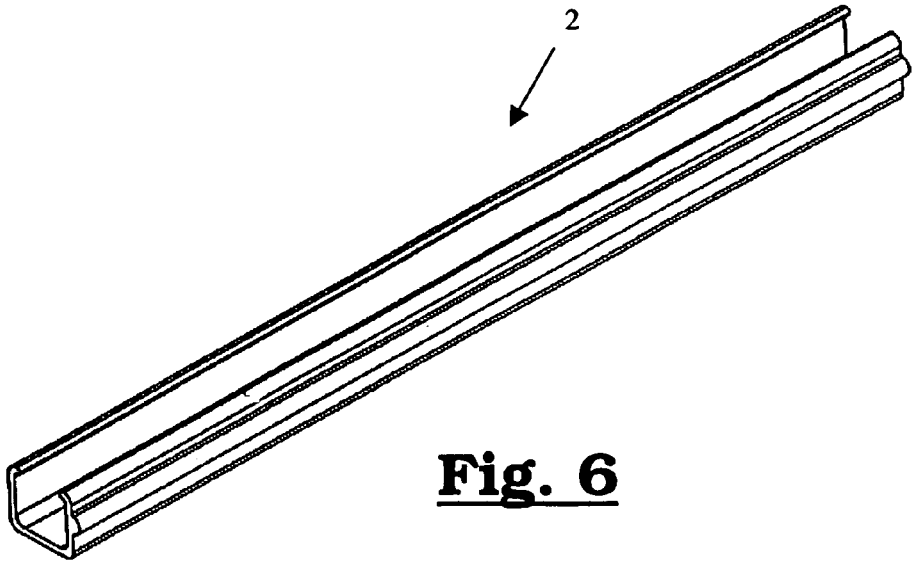
FIG. 6 is representing a rapier rod profile.
Figure 7:
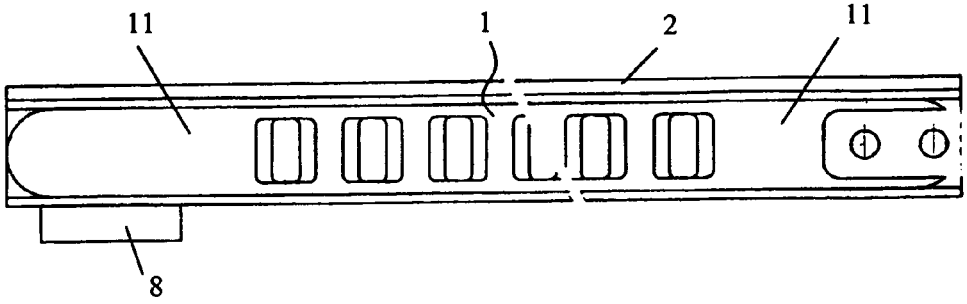
FIG. 7 is representing a side view of a rapier rod according to the invention without a rapier.
Figure 8:
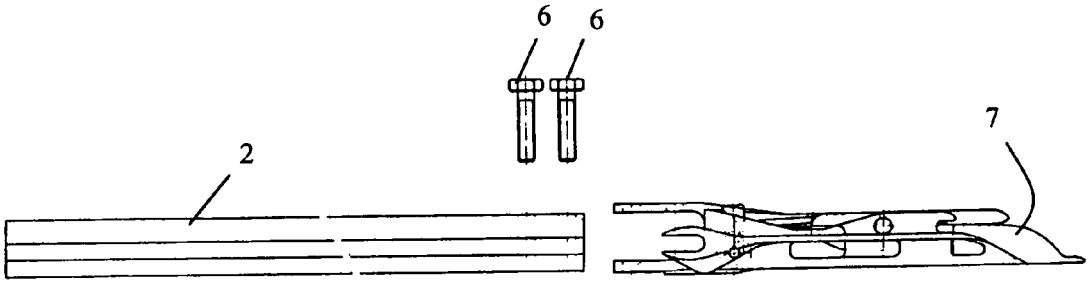
FIG. 8 is representing a bottom view of a rapier rod according to the invention and a corresponding rapier provided to be attached to the said rapier rod.

In order now to make the rapier rod lighter and at the same time to maintain the stiffness and accuracy in a production-friendly manner, allowing the operational speed to be increased and/or wear to be reduced, the invention consist in pre-stressing, in a positioning gauge, the toothed rack (1) made of an elastic material, such as, for instance, a synthetic material, until an accurate tooth profile is obtained and, in this pre-stressed condition, to wrap up the toothed rack (1) in one or several layers of fibre reinforced synthetic cloth, around at least part of the height of the lateral faces (10) being almost at right angles to the surface in which the teeth are situated (see FIGS. 4 and 5).

The fibre reinforced synthetic cloth (9) may be impregnated with resin, in this case, the toothed rack (1), with fibre reinforced synthetic cloth and resin, being cured after having been wrapped up.

The toothed rack (1) wrapped up in fibre reinforced synthetic cloth (9) is attached to the rapier rod profile (2), which, in turn, is mostly made of fibre reinforced synthetic material. This attachment may be realized by means of any joint, such as, for instance, gluing, fixing under stress or by means of a mechanical attachment.

The fibre reinforced synthetic cloth (9) and the rapier rod profile (2) both consist of fibre reinforced synthetic materials, the fibres being carbon fibres, glass fibres or aramide fibres or any other type of reinforcing fibres. Wrapping up the toothed rack (1) may occur for the entire height, but also as represented in FIG. 5, for only a part of the height. The toothed rack (1) represented in FIG. 5 is carried out in a stepped manner, because of which the toothed rack (1) is provided with an edge (12) on the side of the teeth, and the synthetic cloth (9) being situated against the said edge (12). This embodiment has the advantage that stress caused by fibre reinforced synthetic cloth (9) (that has been applied under stress) is not exercising any pressure on the top of the teeth of the toothed rack (1). This top of the teeth having a more limited resistance to deformation, may be less deformed because of this.

The terminal elements (3, 4) according to the state-of-the-art, their most important function being: to maintain a pre-stress on the toothed rack (1), thus relieving the glued joint between toothed rack (1) and rapier rod profile (2) from this pre-stress, are now becoming unnecessary, since this function is taken over by the fibre reinforced synthetic cloth (9) having been wrapped around.

To prevent the rapier rod profile (2) from ending right at a tooth of the toothed rack (1) on the one hand, which may cause a deformation of this tooth caused by the stress of the fibre reinforced synthetic cloth (9) or, on the other hand, to be able to attach the rapier (7), in a particular method according to the invention, the said toothed rack, at least one of its extremities, is provided with a terminal piece (11) made of essentially solid material. Preferably, the terminal piece and the toothed rack are made of the same material. These terminal pieces (11) of the toothed rack (1), either may be made in one piece with the toothed rack (1), when manufacturing the toothed rack (1) or they may be moulded on to a part of the toothed rack (1) with teeth all along its full length. These terminal pieces (11) are likewise wrapped up in the fibre reinforced synthetic cloth (9) together with the toothed rack.

Figure 9:
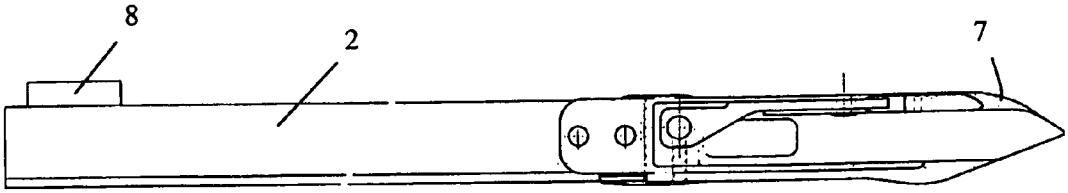
FIG. 9 is representing a side view of a rapier rod, to which a rapier has been attached.

By providing such terminal pieces (11), the terminal elements (3, 4) according to the state-of-the-art neither their means of attachment (5, 6) are no longer required. Consequently this means a decrease in weight of the total rapier rod By integrating the terminal pieces (11) into the toothed rack (1), the possibility to integrate a guiding piece (8) into the terminal piece on the side away from the rapier (7) does not any longer exist indeed. However, this guiding piece (8) may be glued to the rapier rod profile (2) (see FIG. 9).

When the terminal pieces have been integrated into the toothed rack (1), because of the pre-stress of the fibre reinforced synthetic cloth (9) wrapped up, they will form a whole which is significantly stiffer than in the condition not being pre-stressed. This reinforced material is more suitable to attach the rapier (7). Since this terminal piece (11) is constituting one piece with the toothed rack (1), there is no longer need to provide the terminal piece (11) with accessories to be in mesh with the teeth of the toothed rack (1) and to attach it to the toothed rack (1), because of which the total weight of the rapier rod (2) will be yet further reduced.

Rapier weaving machines provided with such a rapier rod (2) with a toothed rack (1) according to the invention are less subject to wear and may be operating at higher speeds, because of the reduction in weight obtained.

The invention claimed is:

1. Manufacturing method comprising a toothed rack from an elastic material, providing the toothed rack with lateral faces and with teeth, prestressing the toothed rack, wrapping a fiber reinforced synthetic cloth around the said toothed rack in the pre-stressed condition in one or several layers of the fibre reinforced synthetic cloth around at least part of a height of the lateral faces at least once over all lateral faces of the toothed rack which includes both lateral faces along the length of the base toothed rack and also the lateral faces at both ends of the toothed rack, the lateral faces being almost at right angles to a surface in which the teeth are situated, wherein after wrapping the synthetic cloth remains in contact with the lateral faces.

2. Method according to claim 1, characterized in that the toothed rack is wrapped up in one or several layers of fibre reinforced synthetic cloth impregnated with resin, after which the toothed rack wrapped up in cloth is then cured.

3. Method according to claim 1, characterized in that the said toothed rack, at least at one of its extremities is provided with a terminal piece made of an essentially solid material.

4. Method according to claim 3, characterized in that the said terminal piece is made in one piece with the toothed rack, such that the terminal piece is integrated into the toothed rack.

5. Method according to claim 3, characterized in that the said terminal piece is attached to the toothed rack.

6. Method according to claim 5, characterized in that the said terminal piece is attached to the toothed rack by means of injection moulding.

7. Method according to claim 3, characterized in that the terminal piece, together with the toothed rack, is wrapped in the fibre reinforced synthetic cloth.

8. Method according to claim 1, characterized in that the toothed rack is made of synthetic elastic material and the prestressing comprises prestressing the toothed rack until an accurate tooth profile is obtained and the wrapping occurs under stress around the prestressed toothed rack.

9. Toothed rack, made of an elastic material, comprising teeth, characterized in that the said toothed rack, in a pre-stressed condition, is wrapped at least once over all lateral faces of the toothed rack which includes both lateral faces along the length of the base toothed rack and also the lateral faces at both ends of the toothed rack in one or several layers of fibre reinforced synthetic cloth around at least part of the height of the lateral faces of the toothed rack, being almost at right angles to a surface of the toothed rack in which the teeth are situated, wherein the wrapped layers of synthetic cloth is in contact with the lateral faces to hold the toothed rack in the prestressed condition.

10. Toothed rack, according to claim 9, characterized in that the said synthetic cloth is comprising fibres chosen from carbon fibres, glass fibres and aramide fibres.

11. Toothed rack, according to claim 9, characterized in that the said synthetic cloth is impregnated with resin, because of which the fibre reinforced synthetic cloth may be cured after having been wrapped around the toothed rack.

12. Toothed rack, according to claim 9, characterized in that the lateral face of the toothed rack is stepped, because of which the toothed rack is provided with an edge on the side of the teeth and the synthetic cloth being situated against the said edge.

13. Toothed rack made by means of a method according to claim 1.

14. Rapier rod profile for a rapier weaving machine, characterized in that the rapier rod profile is provided with a toothed rack according to claim 9.

15. Rapier weaving machine, characterized in that the said weaving machine is provided with a rapier rod profile according to claim 14.

16. Method comprising forming a toothed rack from an elastic material with teeth, a surface in which the teeth are situated, with lateral faces at right angles to the surface in which the teeth are situated, pre-stressing the toothed rack until an accurate tooth profile is obtained, and wrapping the lateral faces of the toothed rack in fiber reinforced synthetic cloth applied under stress at least once over all lateral faces of the toothed rack which includes both lateral faces along the length of the base toothed rack and also the lateral faces at both ends of the toothed rack, and maintaining the prestressed condition of the toothed rack with the fiber reinforced.

17. The method of claim 16, further comprising impregnating the cloth, with the resin before the wrapping.

18. The method of claim 17, further comprising curing the impregnated cloth after the wrapping.

19. The method of claim 16, wherein the wrapping is around a part of a height of the lateral faces.

* * * * *